US006908166B2

(12) United States Patent
Kobayashi et al.

(10) Patent No.: US 6,908,166 B2
(45) Date of Patent: Jun. 21, 2005

(54) INKJET RECORDING DEVICE WITH INK REFRESH FUNCTION

(75) Inventors: Shinya Kobayashi, Hitachinaka (JP); Takahiro Yamada, Hitachinaka (JP); Kunio Satou, Hitachinaka (JP); Hitoshi Kida, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 143 days.

(21) Appl. No.: 10/626,558

(22) Filed: Jul. 25, 2003

(65) Prior Publication Data

US 2004/0130584 A1 Jul. 8, 2004

(30) Foreign Application Priority Data

Jul. 26, 2002 (JP) ..... 2002-217975

(51) Int. Cl.[7] ..... B41J 29/38
(52) U.S. Cl. ..... 347/11; 347/35
(58) Field of Search ..... 347/9, 11, 35, 347/77, 89, 90

(56) References Cited

U.S. PATENT DOCUMENTS 4,313,123 A * 1/1982 Jinnai et al. ..... 347/75
4,866,462 A * 9/1989 Watanabe ..... 347/9
5,659,342 A * 8/1997 Lund et al. ..... 347/35
6,033,050 A * 3/2000 Morita et al. ..... 347/23
6,679,586 B2 * 1/2004 Kobayashi et al. ..... 347/55

FOREIGN PATENT DOCUMENTS

| | | |
|---|---|---|
| JP | 57-61576 | 4/1982 |
| JP | 9-29996 | 2/1997 |
| JP | 2002-36566 | 2/2002 |

* cited by examiner

*Primary Examiner*—Lamson Nguyen
*Assistant Examiner*—Blaise Mouttet
(74) *Attorney, Agent, or Firm*—Whitham, Curtis & Christofferson, PC

(57) ABSTRACT

During a printing operation, a recording device is switched from a normal mode to a refresh ejection mode so as to temporarily increase an ejection frequency. A refresh ink droplet ejected in the refresh ejection mode is deflected to impinge on an ink collector. Recording ink droplets ejected in the refresh ejection mode are deflected and impinge on a recording sheet at positions that are shifted by gradually smaller distances.

8 Claims, 9 Drawing Sheets

INKJET RECORDING DEVICE WITH INK REFRESH FUNCTION

BACKGROUND OF THE INVENTION

1. Field of the Invention

The present invention relates to a drop-on-demand inkjet recording device and particularly to a high-speed line-scan inkjet recording device with an ink refresh function.

2. Description of Related Art

There are continuous type and drop-on-demand type inkjet recording devices. Although continuous type inkjet recording devices constantly eject ink from all nozzles, drop-on-demand inkjet recording devices eject ink droplets only as needed. Sometimes nozzles of drop-on-demand inkjet recording devices will not be fired for long periods during printing. Because inkjet recording devices mainly use water-based ink, whose main component is water, the water-based ink near the opening of non-firing nozzles can evaporate and cohere during such long non-firing periods. Once ink is ejected, the poor condition of the ink in the nozzle can adversely affect ejection performance. In bad situations, the nozzle can be completely clogged by the evaporated or cohered ink so that ejection becomes impossible.

Japanese Patent-Application Publication No. SHO-57-61576 discloses a method of vibrating ink to prevent clogging. During periods of non-ejection, the piezoelectric elements for ejecting ink are applied with a smaller energy than required for actually ejecting an ink droplet. This vibrates the ink near the opening of nozzles so that the ink is less likely to cohere. Therefore, vibrating ink can prevent nozzle clogs without increasing consumption of ink. However, merely vibrating the ink does not prevent the water component of the ink from evaporating. When the ink near the nozzle opening evaporates, the viscosity of the ink increases so that ejection performance can be poor. For example, ejected ink droplets may follow a curved trajectory instead of a desirable straight trajectory. Nozzles can also clog up so that ink ejection is impossible.

Japanese Patent-Application Publication No. HEI-9-29996 discloses performing an ink refresh operation in addition to ink vibration. During the ink refresh operation, recording operations are temporarily stopped, the recording head is moved to a predetermined position that is outside the printing range, and then ink is ejected from all of the nozzles in the head. Overly viscous or partially cohered ink near the opening of the nozzles is discharged with the ink ejection and replenished with fresh ink. This method is superior to vibrating the ink in terms of effectively maintaining ejection performance.

Line scan inkjet recording devices are also known in the art. Conventional line scan inkjet recording devices include a print head with an array of nozzles that extend across the entire width of a recording sheet. Line scan inkjet recording devices can record images at high speed because there is no need to transport the print head across the surface of the recording sheet In its widthwise direction. That is, the recording sheet needs to be merely transported continuously in front of the nozzles. However, whenever a refresh operation is performed, recording operations must be temporarily stopped and the print head is moved to a non-printing region. This reduces the recording speed. Further, a complicated mechanism is required for temporarily stopping sheet transport in this way.

Japanese Patent-Application Publication No. 2002-36566 discloses a deflection-type drop-on-demand inkjet recording device that is capable of performing refresh operations without the need to temporarily stop recording operations and move the print head out of the printing range. The nozzles of the print head are divided into groups of 128 to 1,024 nozzles. When there is a period when none of the nozzles in one of the groups is required for image recording, then all of the nozzles in the group are fired together in a refresh operation. The refresh droplets are charged by an electric field and then deflected by a deflection field away from the recording sheet toward an ink collection unit, where the refresh ink droplets are collected.

However, a refresh operation cannot be performed on any group of nozzles as long as even a single nozzle of the group is being used for image recording. When printing a vertical straight line or other image that is elongated in the transport direction of the recording sheet, then refresh operations cannot be performed for long periods of time on nozzle groups with nozzles used in the elongated image. Nozzles of such groups that are not used to record the image will have problems described above such as ink cohering so that ink ejection is defective or impossible.

To prevent such problems, it is conceivable to provide an ink refresh ejection period in addition to recording ejection periods. The ink refresh ejection period is used solely for ink refresh operations. In general, a time-sharing method is used wherein an ink refresh ejection period is interposed between two consecutive ink recording ejection periods. In order to reduce ink consumption, the fewer times that ink refresh is performed the better. It has been determined by tests that, under normal environmental conditions of temperature and humidity, sufficient effects are achieved by performing refresh operations at a frequency of only 10 Hz–20 Hz.

This type of refresh operation is well suited for low-speed recording devices, but not very well suited for high-speed recording devices, such as line scan inkjet recording devices. Normally recording at high speeds is achieved by electing droplets at a high ink ejection frequency f. However, in order to eject an ink droplet, each voltage drive signal that is applied to a piezoelectric element to eject an ink droplet needs to be applied for a certain time duration, for example, 80 micro seconds as shown in FIG. 1(*a*). This time requirement for duration of the drive signal limits the frequency that signals can be applied. For example, when the drive signal must be a minimum of 80 micro seconds long, then the drive signals cannot be applied at a frequency of greater than 10 kHz, so the maximum ejection frequency fm (Hz) is 10 kHz.

At this time, the speed at which a recording sheet can be transported, that is, a sheet transport speed Vp, can be represented using the following formula:

$$Vp=f/R \tag{1}$$

wherein f is the ejection frequency; and

R is the resolution (in dots/inch) in the sheet transport direction.

For example, the maximum sheet transport speed Vpm is 33.3 inches/second for printing an image with a resolution of 300 dpi (dots/inch) at the maximum ejection frequency fm of 10 kHz.

However, when recording is performed at a high speed near or at the maximum ejection frequency fm of 10 kHz, only a short interval separates successive drive signals as shown in FIG. 1(*a*). In this case, there is insufficient time for also outputting an ink refresh drive signal. A longer interval between successive drive signals is required if the time-sharing method is to be used.

However, normally both the recording resolution and sheet transport speed are maintained constant to facilitate synchronization of ink ejection and sheet transport operations. Therefore, the duration of each drive signal is also constantly the same. Accordingly, the interval between successive drive signals cannot be temporarily lengthened only at certain times. Therefore, even if ink refresh operations are performed only very infrequently, the interval between successive drive signals must be increased for all drive signals as shown in FIG. 1(*b*). As a result, in order to enable refresh operations during printing operations, the actual ejection frequency f must be met to half the maximum ejection frequency fm of 10 kHz or less, that is, to 5 kHz or less.

Naturally, the recording speed Vp also decreases. That is, from formula (1) it can be understood that:

$$Vp=f/R=16.7 \text{ inches/second} \quad (2)$$

The sheet-transport speed also drops by half or less. This creates a big problem when attempting to produce a high-speed recording device.

SUMMARY OF THE INVENTION

It is an objective of the present invention to provide an inkjet recording device capable of performing an optional ink refresh operation without sacrificing recording speed.

In order to attain the above and other objects, the present invention provides an inkjet recording device including a plurality of nozzles for ejecting ink droplets, a first signal generator that generates a recording ejection signal, in response to which the nozzles selectively eject recording ink droplet, a changing unit that, during a frequency changing period, temporarily changes an ejection frequency that is common to all of the nozzles, a second signal generator that generates, during the frequency changing period, a refresh ejection signal in response to which the nozzles selectively eject refresh ink droplet, an electric field generator that generates an electric field for deflecting the refresh ink droplet, and an ink collector that collects the deflected refresh ink droplet.

BRIEF DESCRIPTION OF THE DRAWINGS

In the drawings:

FIG. 1(*b*) is timing chart showing a drive signal output at a maximum ejection frequency possible when an ink refresh operation is also performed;

DETAILED DESCRIPTION OF THE EMBODIMENTS

Next, an inkjet recording device 1 according to an embodiment of the present invention will be described with reference to the accompanying drawings.

Figures 1A, 1B:
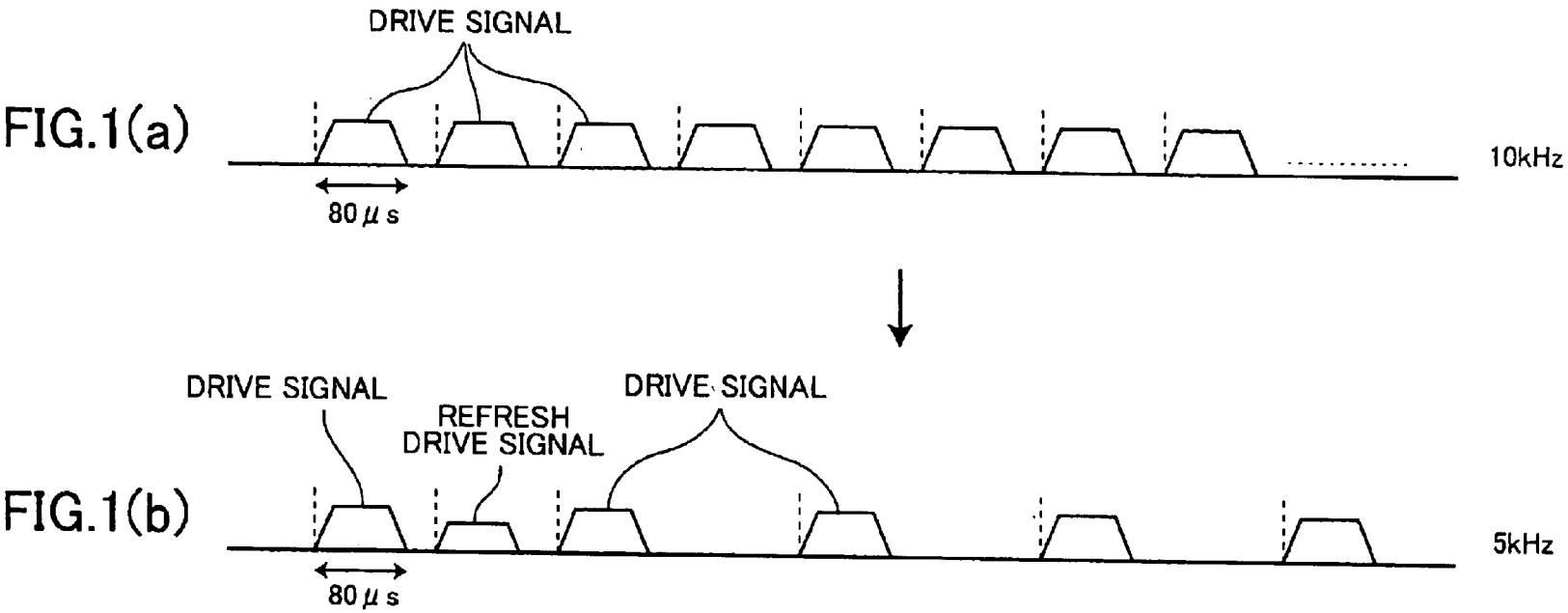
FIG. 1(*a*) is timing chart showing a drive signal output at a maximum ejection frequency.
Figure 2:
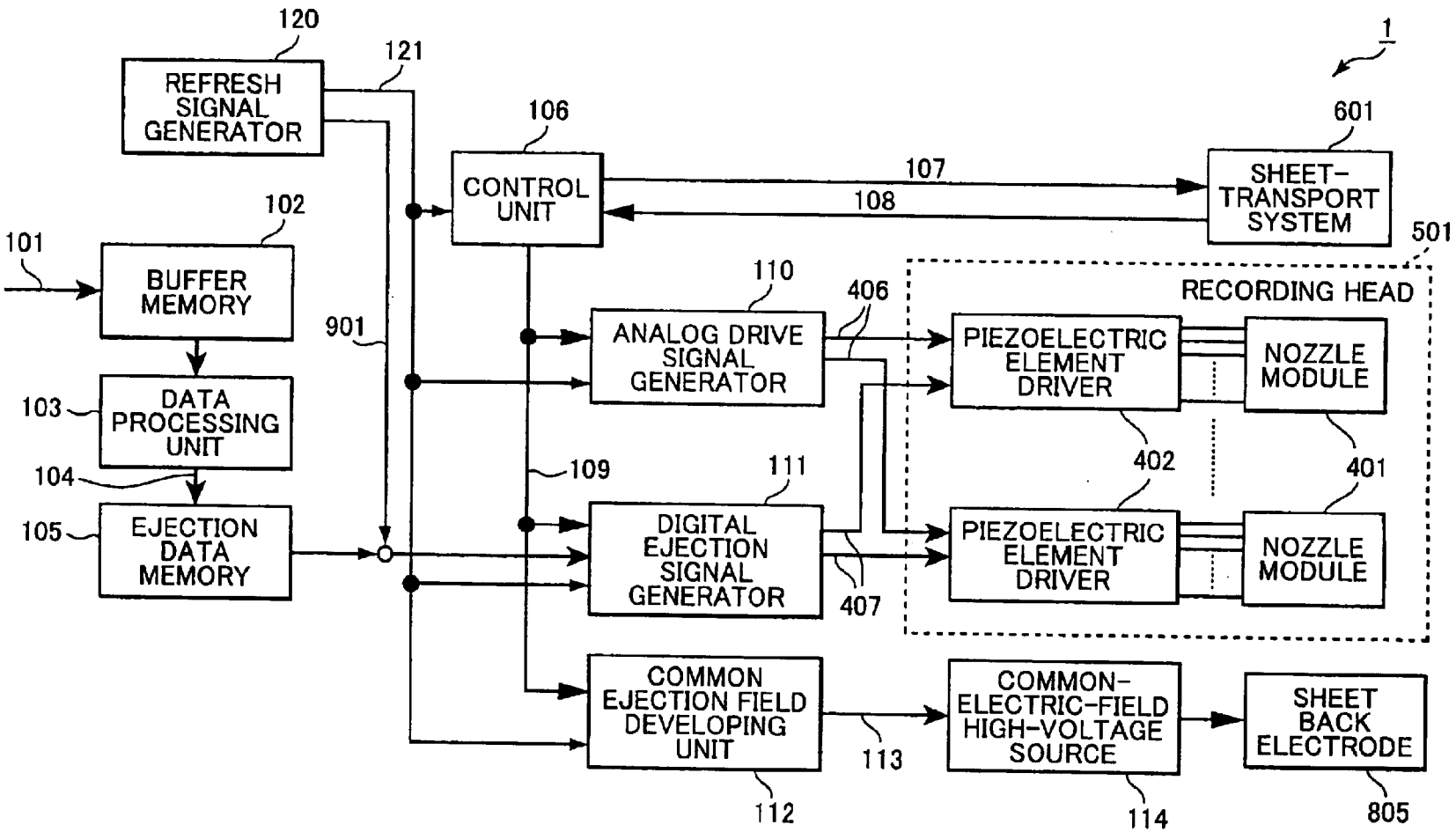
FIG. 2 is a block diagram showing electrical components of an inkjet recording device according to an embodiment of the present invention.

As shown in FIG. 2, the inkjet recording device 1 includes a recording head 501 and a sheet-transport system 601. The recording head 501 is mounted an the sheet-transport system 601. The recording head 501 includes a plurality of nozzle modules 401 and a plurality of piezoelectric element drivers 402. The piezoelectric element drivers 402 ere provided in a number corresponding to the number of nozzle modules 401 and are each connected to a corresponding one of the nozzle modules 401. In order to achieve color printing, a plurality of different recording heads 501, one for each different color, is provided. However, in order to facilitate explanation, the following explanation will be provided assuming that only a single recording head 501 is provided.

Figure 3:
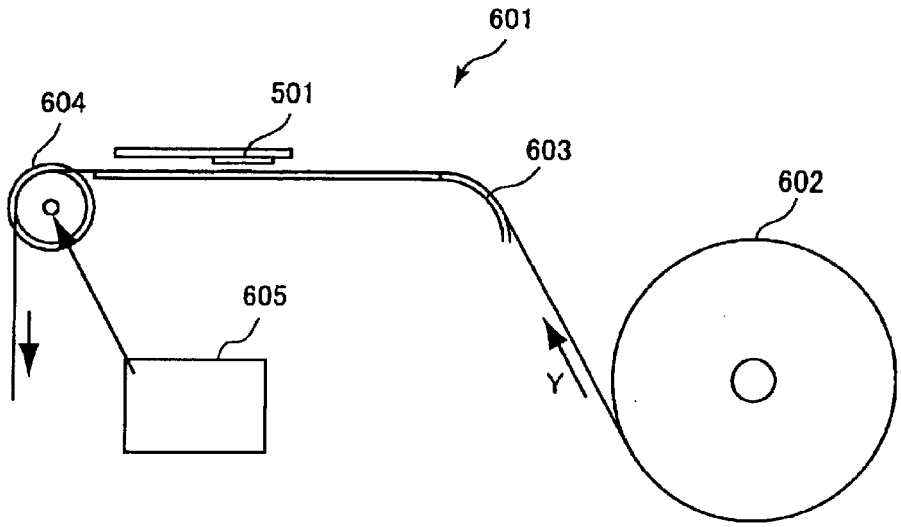
FIG. 3 is a side view showing a recording head and a sheet transport system of the inkjet recording device of the embodiment.

As shown in FIG. 3, the sheet-transport system 601 includes a guide 603, a transport drive roller 604, and a rotary encoder 605. Although not shown in the drawings, the sheet-transport system 601 also includes a transport mechanism. Under operation of the transport mechanism, a continuous recording sheet 602 is transported in a sheet transport direction Y to the guide 603, follows the guide 603 to a position directly below the recording head 501, and is then discharged out via the transport drive roller 604. The rotary encoder 605 is attached to the transport drive roller 604 and outputs a sheet position pulse 108 indicated in FIG. 2 in accordance with the position of the continuous recording sheet 602 in the sheet transport direction Y. Although not shown in the drawings, a drive motor is attached to the transport drive roller 604.

As shown in FIG. 2, the inkjet recording device 1 further includes a buffer memory 102, a data processing unit 103 such as a CPU, an ejection data memory 105, a sheet control unit 106, an analog drive signal generator 110, and a digital ejection signal generator 111. Although not shown in the drawings, a computer system is connected to the inkjet recording device 1. The user uses the computer system to prepare text and the like to be recorded using the inkjet recording device 1. The text may be written at the computer system in any of a variety of different page-description languages. However, before sending the text to the inkjet recording device 1, the computer system develops the text into bitmap data 101 to match the specifications (resolution and the like) of the inkjet recording device 1. According to the present embodiment, the bitmap data 101 is monochrome bitmap data wherein a logical value of 1 indicates "record" and a logical value of 0 indicates "non-record." It should be noted that even if the computer system supplies color or multi-bit bitmap data, the bitmap data can be easily used in the inkjet recording device 1 by converting it into monochrome bitmap data. Since such conversion operations are well known in the art, their detailed description will be omitted here.

When recording is started, one job's worth (i.e., a plurality of pages' worth) of bitmap data 101 is input serially into the buffer memory 102. The buffer memory 102 temporarily stores the bitmap data 101. During or after operations for storing the bitmap data 101 into the buffer memory 102, the data processing unit 103 serially converts the bitmap data 101, that is temporarily stored in the buffer memory 102, into ejection data 104 that meets the ejection specifications of the inkjet recording device 1. The ejection data 104 is stored into the ejection data memory 105. When storage of the ejection data 104 into the ejection data memory 105 is completed, then the sheet control unit 106 outputs an operation command 107 to the sheet-transport system 601 to command start of sheet transport. As sheet transport starts, the sheet control unit 106 starts receiving the sheet position pulses 108 from the rotary encoder 605. According to the present embodiment, the sheet position pulses 108 are outputted at a rate of 500 pulses/inch, or once about every 17 micro millimeter. When the continuous recording sheet 602 reaches a suitable recording position, the sheet control unit 106 generates a sheet-position synchronization signal 109 that matches the resolution of the inkjet recording device 1. The resolution of the inkjet recording device 1 according to the present embodiment is 300 dpi. Accordingly, the sheet-position synchronization signal 109 is generated once each time the sheet position pulse 108 is output five times, that is, each time the continuous recording sheet 602 moves $1/300^{th}$ of an inch. The sheet-position synchronization signal 109 is sent to the analog drive signal generator 110 and the digital ejection signal generator 111. The sheet-position synchronization signal 109 is also sent to the piezoelectric element drivers 402 as a latch clock L-CLK shown in FIG. 4.

As will be described later, the maximum ejection frequency fm of the inkjet recording device 1 is 10 kHz. However, the normal ejection frequency f is set to 8 kHz. The sheet transport speed Vp can be determined by substitution using formula (1):

$$Vp=f/R=26.7 \text{ inch/s} \quad (3)$$

However, because the ink ejection timing is determined based on the sheet position pulses 108 from the rotary encoder 605, the ejection frequency f will vary a bit if the sheet transport speed Vp fluctuates.

The analog drive signal generator 110 prepares an analog drive signal 406 that corresponds to each of the nozzle modules 401 and supplies the analog drive signal 406 to the piezoelectric element drivers 402 in synchronization with the sheet-position synchronization signal 109. The digital ejection signal generator 111 sends a shift clock S-CLK shown in FIG. 4 to the ejection data memory 105 and the piezoelectric element drivers 402 in synchronization with the sheet-position synchronization signal 109. The digital ejection signal generator 111 retrieves and amplifies the ejection data 104 from the ejection data memory 105. The digital ejection signal generator 111 uses the ejection data 104 to prepare recording ejection data 407 and supplies the recording ejection data 407 to the piezoelectric element drivers 402.

Figure 6:
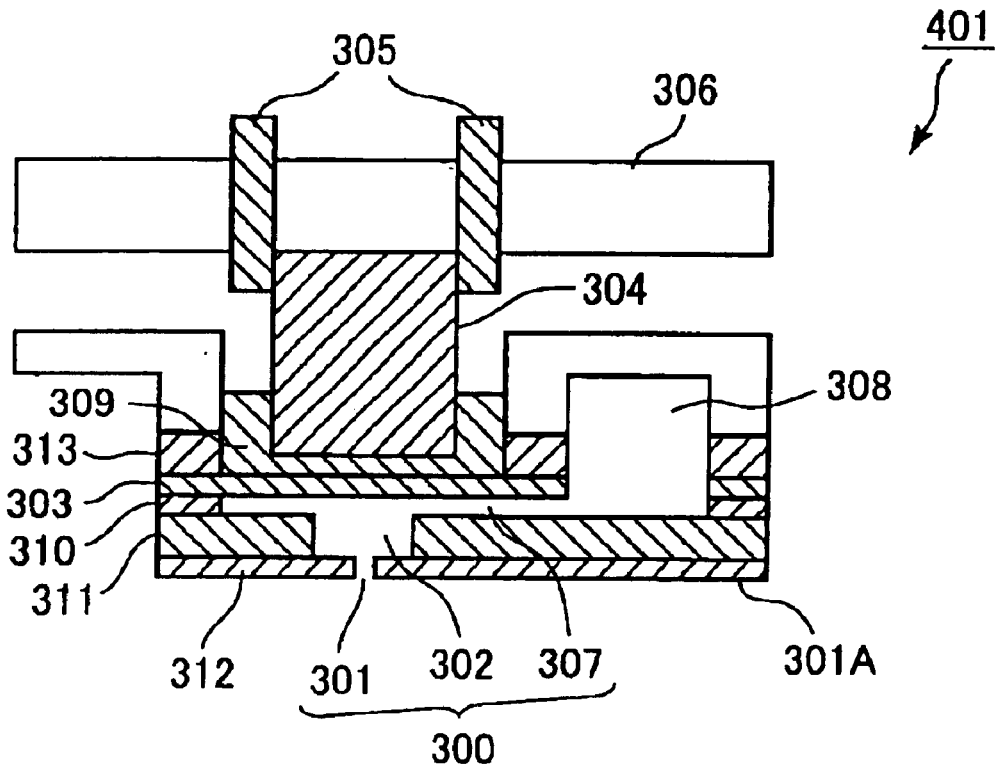
FIG. 6 is a cross-sectional view showing the head module.

Next, the nozzle modules 402 of the recording head 501 will be described while referring to FIG. 6. FIG. 6 is a cross-sectional view showing an example nozzle module 401. Each nozzle module 401 has substantially the same configuration, so the following explanation will be provided using the nozzle module 401 shown in FIG. 6 as an example. The nozzle module 401 includes an orifice plate 312, a pressure chamber plate 311, a restrictor plate 310, and a piezoelectric element fixing plate 306. The orifice plate 312 is formed with 128 nozzles 300, only one of which is shown in FIG. 6. A common ink channel 308 is formed in the nozzle nodule 401. The common ink channel 308 is for supplying ink to all of the nozzles 300. Each of the nozzles 300 includes a nozzle orifice 301 formed in the orifice plate 312, a pressure chamber 302 formed in the pressure chamber plate 311, and a restrictor 307 formed in the restrictor plate 310. The restrictor 307 connects the common ink channel 308 with the pressure chamber 302 and controls the amount of ink that flows from the common ink channel 308 to the pressure chamber 302.

The nozzles 300 each include a diaphragm 303, a piezoelectric element 304, and a support plate 313. The diaphragm 303 and the piezoelectric element 304 are connected together by a resilient material 309 such as silicon adhesive. Each piezoelectric element 304 has a pair of signal input terminals 305. The piezoelectric elements 304 are configured to contract when a voltage is applied between the corresponding signal input terminals 305 and remain unchanged in shape when no voltage is applied. The support plate 313 is for reinforcing the diaphragm 303.

The diaphragm 303, the restrictor plate 310, the pressure chamber plate 311, and the support plate 313 are made from stainless steel, for example. The orifice plate 312 is made from nickel, for example. The piezoelectric element fixing plate 306 is made from an insulating material, such as ceramic or polyimide.

Ink supplied from an ink tank (not shown) is distributed through the common ink channel 308 to the restrictors 307 and through the restrictors 307 to the pressure chambers 302 and the nozzle orifices 301. When voltage is applied between the signal input terminals 305, the corresponding piezoelectric element 304 deforms so that a portion of the ink in the pressure chamber 302 is ejected from the corresponding nozzle orifice 301. It should be noted that the inkjet recording device 1 according to the embodiment uses ink with electrically conductive properties.

Figure 4:
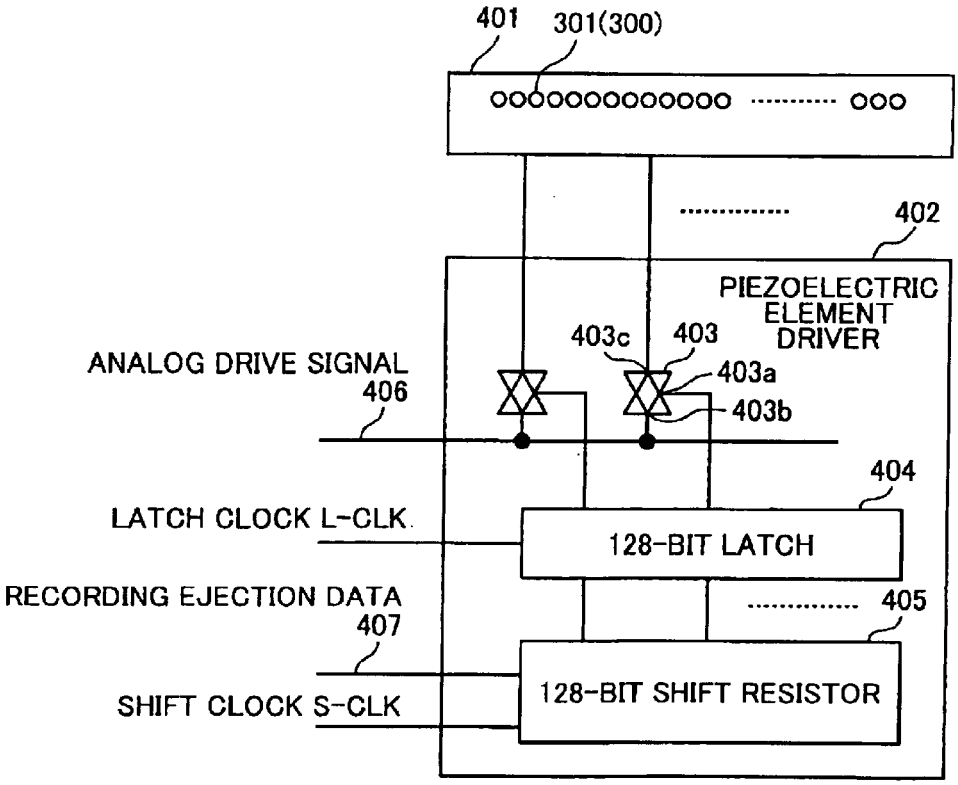
FIG. 4 is a block diagram showing a head module and a piezoelectric element driver of the recording head.
Figure 7:
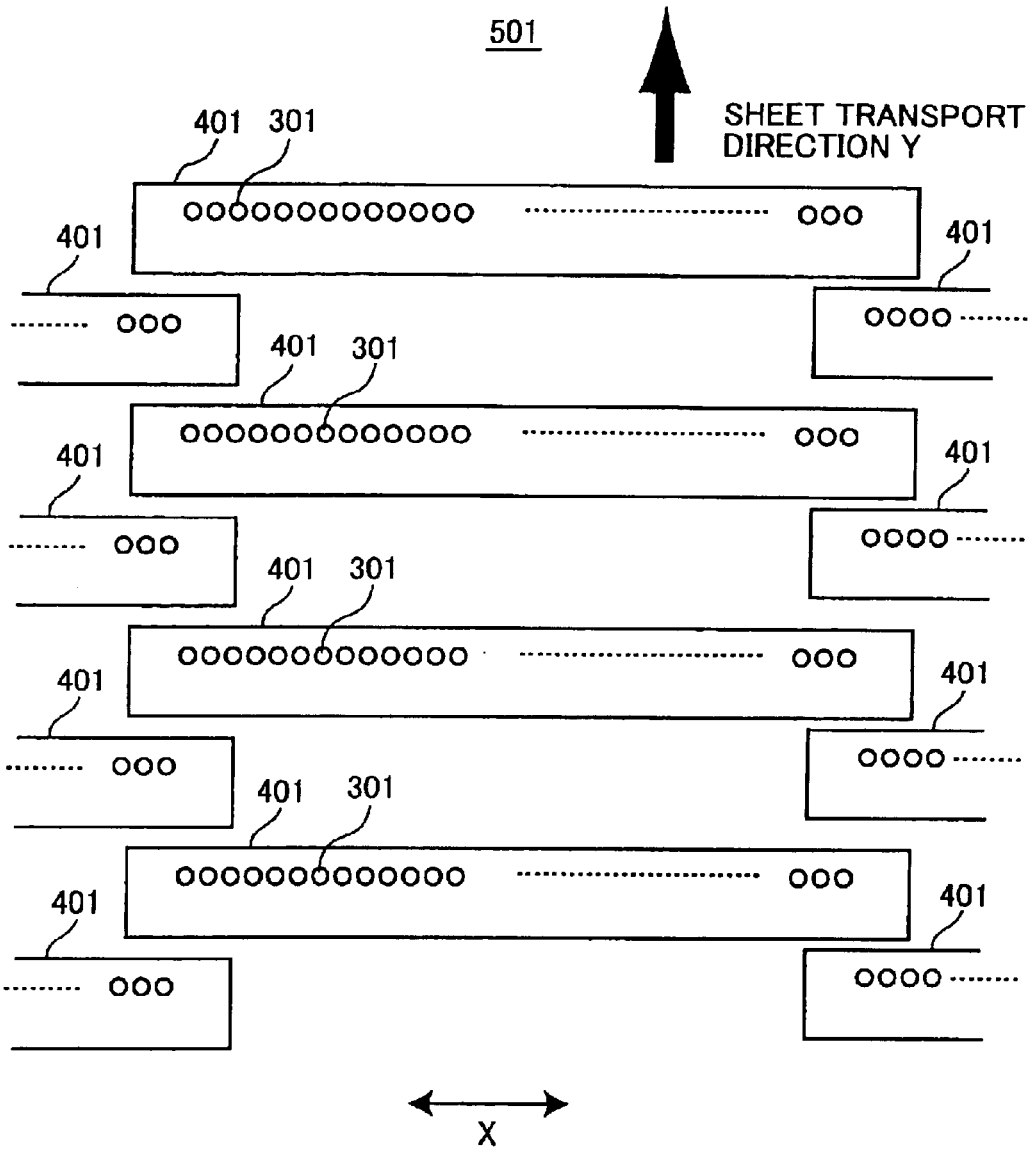
FIG. 7 is a plan view showing an array of head modules.

As shown in FIG. 4, the 128 nozzles 300 are juxtaposed in a line. Adjacent nozzles 300 are separated from each other by the same distance. The pitch of the nozzles 300 centered on the nozzle orifices 301 is 75 nozzles/inch (npi). The pitch of the nozzles 300 is also referred to as the nozzle density. As shown in FIG. 7, the nozzle modules 401 are juxtaposed in groups of four in the direction of sheet transport Y. By distributing the nozzle modules 401 in this way, even though each nozzle module 401 has a low nozzle pitch of 75 dpi in the width direction X of the recording sheet, the nozzle pitch of the recording head 501 overall is 300 dpi so that the recording head 501 can record images having a resolution of 300 dpi.

Next, the piezoelectric element drivers 402 will be explained. Each of the piezoelectric element drivers 402 is a well-known piezoelectric element driver and as shown in FIG. 4 includes 128 analog switches 403, a 128-bit latch 404, and a 128-bit shift resistor 405. The shift resistor 405 is input with the shift clock S-CLK from the sheet control unit 106 and recording ejection data 407 from the digital ejection signal generator 111. The recording ejection data 407 is 128 bit serial data that corresponds to the 128 nozzles 300. Each logical value of 1 in the recording ejection data 407 indicates that an ejection is to be performed and each logical value of 0 indicates that no ejection is to be performed. The latch 404 is input with 128-bit parallel data from the shift resistor 405 and the latch clock L-CLK from the sheet control unit 106.

Figure 5:
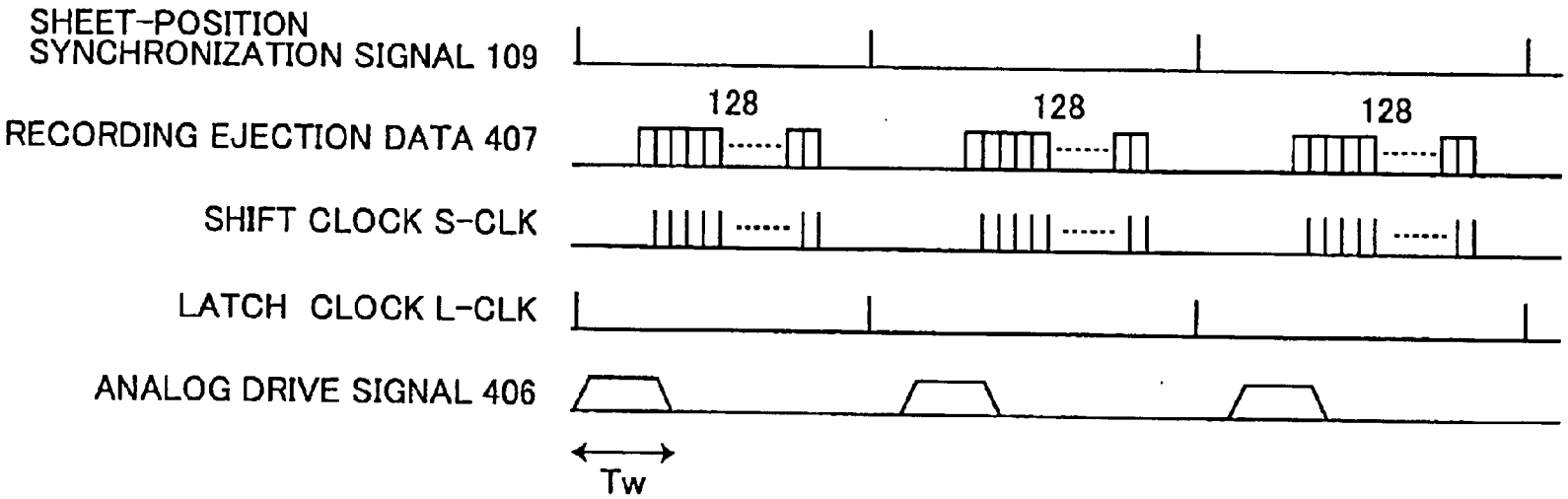
FIG. 5 is a timing chart showing basic timings of the piezoelectric element driver.

Each analog switch 403 includes a switch terminal 403*a*, an input terminal 403*b*, and an output terminal 403*c*. Each switch terminal 403*a* is input with corresponding output from the latch 404 and each input terminal 403*b* is input with the analog drive signal 406. The analog switch 403 outputs the analog drive signal 406 being applied to the input terminal 403*b* to the output terminal 403*c* when the switch terminal 403*a* is applied with a logical value of 1. On the other hand, the analog switch 403 opens the output terminal 403*c* when the switch terminal 403*a* is applied with a logical value of 0 so the analog drive signal 406 is not output to the output terminal 403*c*. The output terminal 403*c* of the analog switch 403 is connected to one of the signal input terminals 305 of the corresponding nozzles 300. The other signal input terminal 305 is connected to ground. That is, the analog drive signal 406 is a signal used commonly for all of the 125 nozzles 300 of the same nozzle module 401 and is for driving the 128 piezoelectric elements 304. A variety of drive waveforms can be used as the analog drive signal 406. According to the present embodiment, the trapezoidal waveform shown In FIG. 5 is used. The trapezoidal waveform is produced by application of 24V for a duration (time width) Tw of about 80 microseconds.

Next, basic operations of the piezoelectric element drivers 402 will be described with reference to the timing chart of FIG. 5. The latch clock L-CLK is generated when the sheet-position synchronization signal 109 is generated. When the latch clock L-CLK is input to the piezoelectric element drivers 402, all the recording ejection data 407 that was stored in the shift resistor 405 during the preceding cycle is stored in the latch 404 and outputted to the switch terminal 403*a* of the analog switch 403. At the same time, the analog drive signal 406 is input to the input terminal 403*b* of the analog switch 403 simultaneously with output of the recording ejection data 407 to the switch terminal 403*a*. At this time, an ink droplet is ejected from nozzles 300 where the recording ejection data 407 is a logical value of 1. No ejection is performed where the recording ejection data 407 is a logical value of 0. Next, the recording ejection data 407 is serially stored in the shift resistor 405 in synchronization with the shift clock S-CLK. Once a full complement of 128 bits is stored in the shift resistor 405, then generation of the next sheet-position synchronization signal 109 is awaited. That is, the content of the recording ejection data 407 represents which nozzles 300 will be fired during the next cycle.

In order to record at high speeds, normally the ink ejection frequency is raised and recording is performed at a high frequency. However, the latch clock L-CLK must have an interval between successive pulses that is long enough for the time width Tw of the analog drive signal 406. According to the present embodiment, the time width Tw of the analog drive signal 406 is about 80 microseconds so it is impossible to drive the recording head 501 faster than 10 kHz. Therefore, the maximum ejection frequency fm is 10 kHz.

The inkjet recording device 1 further includes an electric field developing unit and an ink collection unit. The electric field developing unit develops an electric field for charging ink droplets and deviating the trajectory of the charged ink droplets. The same electric field developing unit is used for all of the nozzles 300 and includes, as shown in FIG. 2, a common electric field developing unit 112, a common-electric-field high-voltage source 114, and a sheet back electrode 805. The common electric field developing unit 112 supplies a common electric field signal 113 to the common-electric-field high-voltage source 114 in synchronization with the sheet-position synchronization signal 109. The common-electric-field high-voltage source 114 sets voltage developed at the sheet back electrode 805 in accordance with voltage of the input common electric field signal 113. Normally, the common electric field signal 113 is not supplied to the common-electric-field high-voltage source 114, so the common-electric-field high-voltage source 114 maintains the electric potential of the sheet back electrode 805 at 0V.

Figure 8:
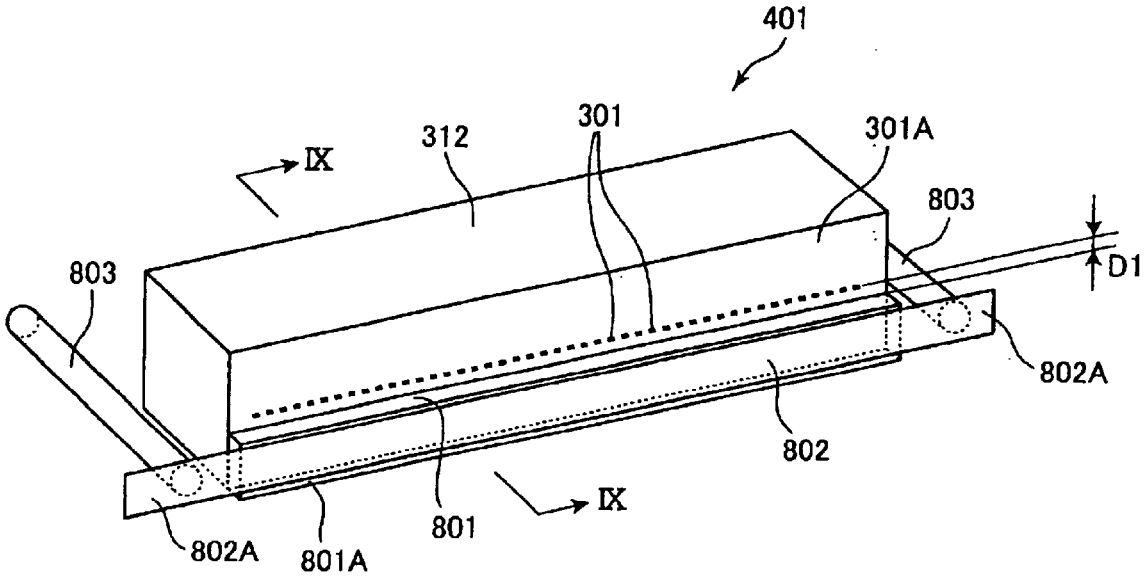
FIG. 8 is a perspective view showing the head module.
Figure 9:
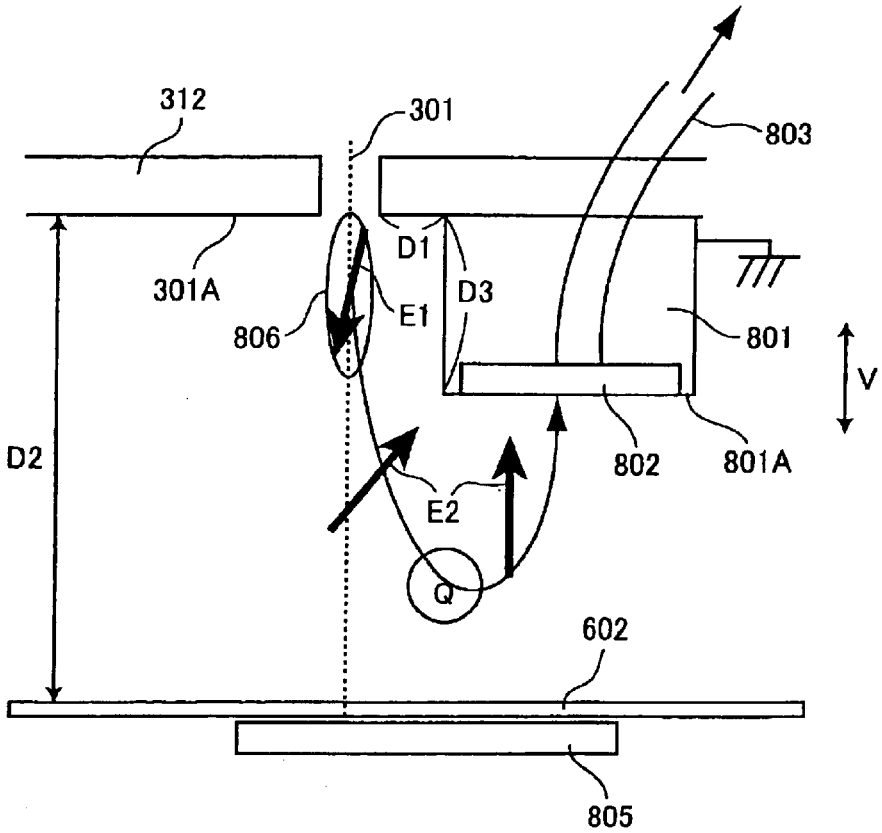
FIG. 9 is a side view showing an ejected refresh ink droplet being deflected and collected.

The ink collection unit collects ink droplets that return to the recording head 501 and, as shown in FIGS. 8 and 9, includes an ink collection electrode 801, a metal mesh 802, and plastic tubes 803. As shown in FIG. 8, the ink collection electrode 801 is a single plate-shaped electrode and is attached to a nozzle surface 301A of the orifice plate 312 in parallel with the nozzle row. The ink collection electrode 801 is separated from the nozzle orifices 301 of the nozzle rows by a distance D1 of about 0.3 mm. The ink collection electrode 801 has the same positional relationship with all 128 of the nozzles 300. The metal mesh 802 is adhered to a surface 801A of the ink collection electrode 801. The ends 802A of the metal mesh 802 protrude from the ink collection electrode 801. The plastic tubes 803 are attached to the ends 802A of the metal mesh 802 that protrude to the outside of the ink collection electrode 801. Although not shown in the drawings, a suction pump is attached to the plastic tubes 803. The ink collection electrode 801 and the orifice plate 312 are electrically grounded.

As shown in FIG. 9, the sheet back electrode 805 is provided to the rear of the continuous recording sheet 602. The sheet back electrode 805 is electrically insulated. The sheet back electrode 805 is a single plate-shaped electrode that extends in the direction in which the nozzle row extends. The sheet back electrode 805 has the same positional relationship with all of the 128 nozzles 300. According to the present embodiment, the nozzle surface 301A (nozzle orifices 301) and the continuous recording sheet 602 are separated by a distance D2 of 1.5 mm and the ink collection electrode 801 is formed with a thickness D3 of 0.4 mm.

As shown in FIG. 2, the inkjet recording device 1 further includes a refresh signal generator 120. The refresh signal generator 120 judges whether or not a refresh operation is required. When a refresh operation is required, then the refresh signal generator 120 outputs a refresh signal 121 that switches the inkjet recording device 1 from ejection mode to a refresh ejection mode. The refresh signal generator 120 also stores refresh ejection data 901 to be described later.

The inkjet recording device 1 can be switched to the refresh ejection mode at any optional timing that need not be synchronized with the print signal. The refresh signal generator 120 refers to the following conditions when judging whether to switch the inkjet recording device 1 to the refresh ejection mode:

1) Elapse of a fixed period: a refresh operation is performed at a fixed time interval of about 10-20 Hz in the conventional manner.

2) Recording history: the fewer ejections shown in the past record for the nozzles 300, the more the refresh signal generator 120 shortens the cycle at which the inkjet recording device 1 is switched to the refresh ejection mode.

3) Environmental conditions: the refresh signal generator 120 shortens the cycle at which the inkjet recording device 1 is switched to the refresh ejection mode under cool (low temperature) and dry (low humidity) conditions because the ink in the nozzles 300 will become viscous at low temperature and will dry more quickly at low humidity.

4) Passage of time: the older the nozzles 300 are, the more the refresh signal generator 120 shortens the cycle at which the inkjet recording device 1 is switched to the refresh ejection mode.

5) Ink conditions: the refresh signal generator 120 shortens the cycle at which the inkjet recording device 1 is switched to the refresh ejection mode when the type of ink used in the nozzles 300 is an easily drying type.

Figure 10:
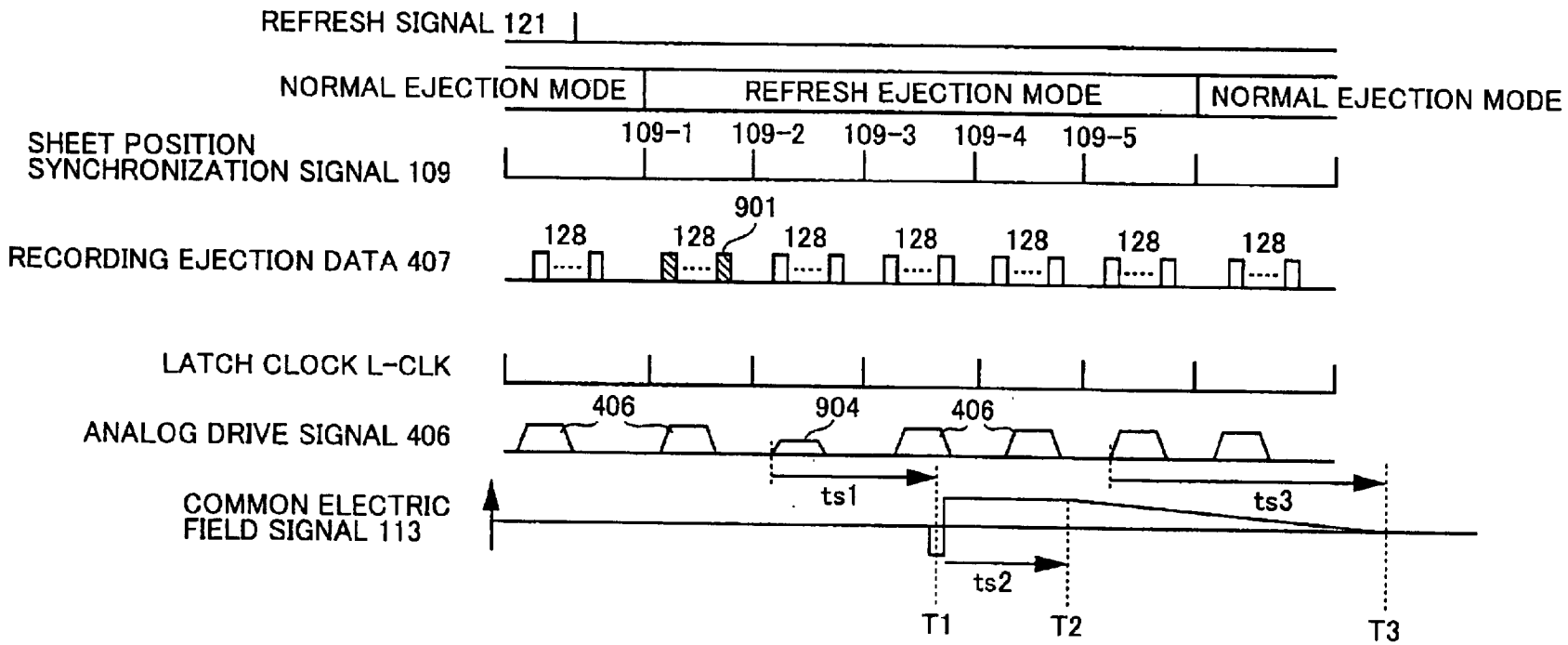
FIG. 10 is a timing chart showing various signals for driving the piezoelectric element driver.

When the refresh signal generator 120 judges that a refresh operation is required, the refresh signal generator 120 prepares the refresh signal 121 and outputs the refresh signal 121 to the sheet control unit 106, the analog drive signal generator 110, the digital ejection signal generator 111, and the common electric field developing unit 112. Upon receiving refresh signal 121, the sheet control unit 106, the analog drive signal generator 110, the digital ejection signal generator 111, and the common electric field developing unit 112 perform operations as indicated in FIG. 10.

That is, the sheet control unit 106 temporarily changes the frequency of the sheet-position synchronization signal 109. More particularly, during the normal ejection mode, the sheet-position synchronization signal 109 is generated once each time five sheet position pulses 108 are generated. However, during the refresh ejection mode, the sheet-position synchronization signal 109 is generated once each time four sheet position pulses 108 are generated. According to the present embodiment, the refresh ejection mode continues during a time period required to transport the continuous recording sheet 602 by four dots' distance at a resolution of 300 dpi. Said differently, during the normal ejection mode, the sheet-position synchronization signal 109 is generated once each time the continuous recording sheet 602 is transported one dot's distance at a resolution of 300 dpi. Therefore, the sheet-position synchronization signal 109 is generated four times during the time required to transport the continuous recording sheet 602 four dots' distance at a resolution of 300 dpi. In contrast to this, during the refresh ejection mode, the sheet-position synchronization signal 109 is generated five times during the time required for the continuous recording sheet 602 by a distance equivalent to four dots at a resolution or 300 dpi. That is, the sheet-position synchronization signal 109 is generated once each time the continuous recording sheet 602 is transported by a distance equivalent to one dot at a resolution of 375 dpi.

These operations will be described in more detail with reference to the timing chart of FIG. 10. When the refresh signal 121 is generated, then at the next sheet-position synchronization signal 109 the inkjet recording device 1 switches from the normal ejection mode to the refresh ejection mode. As a result, the interval of the sheet-position synchronization signal 109 is reduced, that is, the sheet-position synchronization signal 109 is generated every 1/375 inch that the continuous recording sheet 602 is transported instead of only every 1/300 inch. During the refresh ejection mode, the sheet-position synchronization signal 109 is generated five times at the 1/375-inch interval as indicated by 109-1, 109-2, 109-3, 109-4, 109-5 in FIG. 10. The inkjet recording device 1 reverts to the normal ejection mode after the sheet-position synchronization signal 109 is generated for the five times 109-1, 109-2, 109-3, 109-4, 109-5. Once the inkjet recording device 1 switches back to the normal ejection mode, the interval of the sheet-position synchronization signal 109 returns to 1/300 inch.

On the other hand, the digital ejection signal is generator 111 retrieves the refresh ejection data 901 from the refresh signal generator 120 in synchronization with the sheet-position synchronization signal 109-1 and sends the refresh ejection data 901 to the piezoelectric element drivers 402. Next, the digital ejection signal generator 111 sends the recording ejection data 407 retrieved from the ejection data memory 105 and sends the recording ejection data 407 to the piezoelectric element drivers 402 in synchronization with the sheet position synchronization signals 109-2 to 109-5. Next, the inkjet recording device 1 is reverted back to the normal ejection mode, wherein only recording ejection data 407 retrieved from the ejection data memory 105 is sent to the piezoelectric element drivers 402 in synchronization with the 300 dpi sheet-position synchronization signal 109.

The analog drive signal generator 110 prepares and outputs the analog drive signal 406 in synchronization with the sheet-position synchronization signal 109-1. Then, the analog drive signal generator 110 temporarily changes the waveform of the analog drive signal 406 to produce a refresh drive signal 904 and outputs the refresh drive signal 904 in synchronization with the sheet-position synchronization signal 109-2. Afterward, the analog drive signal generator 110 prepares and outputs the analog drive signal 406 in synchronization with the sheet position synchronization signals 109-3 to 109-5. Afterward, the inkjet recording device 1 reverts to the normal ejection mode. According to the present embodiment, the analog drive signal generator 110 produces the refresh drive signal 904 by reducing the voltage value of the analog drive signal 406 compared to the voltage used for ejecting a normal ink droplet.

The common electric field developing unit 112 maintains the common electric field signal 113 at 0V during the normal ejection mode. However, as shown in FIG. 10 the common electric field developing unit 112 controls the common electric field signal 113 to a negative voltage for a short time period centered on a timing T1. The timing T1 is after a duration of time ts1 of 50 to 80 microseconds elapses after the rising edge of the refresh drive signal 904, which was generated based on the refresh signal 121. The common electric field signal 113 is maintained at the negative voltage for a period of about 10 microseconds that centers on the timing T1. Then, the common electric field signal 113 is switched to a positive voltage of fixed value until a timing T2, which is a duration of time ts2 after timing T1. Starting after the timing T2, the voltage value of the common electric field signal 113 is gradually decreased until it reaches a voltage value of 0V at timing T3. The timing T3 is a duration of time ts3 after the rising edge of the analog drive signal 406 that is synchronized with the sheet-position synchronization signal 109-5. As a result, the voltage at the sheet back electrode 805 is maintained at a negative voltage Vcm of −15 kV for the first 10 microseconds after the common electric field signal 113 is switched to a negative voltage, is then maintained at a positive voltage Vcp of 1.5 kV until the timing T2, and then gradually reduced to a voltage value of 0V at timing T3. It should be noted that the negative voltage Vcm is not limited to −1.5 kV, but could be any value from −1.0 kV to −1.5 kV. Similarly, the positive voltage Vcp is not limited to 1.5 kV, but could be any value from 1.0 kv to 1.5 kV.

As described above, the orifice plate 312 and the ink collection electrode 801 are electrically grounded. Therefore, when a voltage is applied at the sheet back electrode 805, an electric field that corresponds to the applied voltage develops between the sheet back electrode 805 and the orifice plate 312/ink collection electrode 801, Next, the trajectory of the refresh droplet ejected during the refresh ejection mode will be described with reference to FIG. 9. The refresh drive signal 904 that is generated in synchronization with the sheet-position synchronization signal 109-2 is applied to the piezoelectric element 304 through the piezoelectric element drivers 402. As a result, a refresh ink droplet 806 is ejected from the nozzle orifice 301. Although not shown in the drawing, at first the refresh ink droplet 806 is still connected with the meniscus of ink in the nozzle orifice 301. However, once the refresh ink droplet 806 extends to a certain length, it breaks away from the ink of the meniscus as shown in FIG. 9. The refresh ink droplet 806 breaks away from the ink of the meniscus at the timing T1, that is, after the time ts1 elapses from the rising edge of the refresh drive signal 904. The ink droplet break away timing T1 is known to be consistent (i.e., not to fluctuate much) regardless of the ink droplet speed and environmental conditions.

An electric field E1 shown in FIG. 9 is generated while the negative voltage Vcm of −1.5 kV is applied to the sheet back electrode 805 for the 10 microsecond period centered on the ink droplet break away time T1. The electric field E1 instantly polarizes the charge in the refresh ink droplet 806. The electric field E1 faces downward for the most part, although it slants slightly to the left as viewed in FIG. 9 under influence from the side surface of the ink collection electrode 801. Therefore, positive charge will accumulate in the lower portion of the refresh ink droplet 806 while the refresh ink droplet 806 is still connected to the meniscus. The refresh ink droplet 806 will therefore have a positive charge after breaking away from the meniscus. Next, the sheet back electrode 805 is applied with the positive voltage Vcp of 1.5 kV to generate an electric field E2. The electric field E2 faces substantially upward. Therefore, the speed of the positively charged refresh ink droplet 806 toward the continuous recording sheet 602 drops dramatically until the speed and direction of the refresh ink droplet 806 reverses and the refresh ink droplet 806 starts moving hack toward the recording head 501. Because the electric field E2 slants slightly to the right under influence from the side surface of the ink collection electrode 801, the refresh ink droplet 806 does not return to the nozzle orifice 301, but instead catches in the metal mesh 802 on the ink collection electrode 801. The ink seeps toward the plastic tubes 803 under force of capillary action. The plastic tubes 803 suck up and discharge the ink. The position where the refresh ink droplet 806 changes direction and starts to return back to the orifice plate 312 can be approximated using the following formula:

$$\lambda = m \times v_0^2 / (2 \times q \times E) \quad (4)$$

wherein 1 is the maximum distance in the vertical direction V from the nozzle orifice 301 to the point where the ink droplet U-turns;

m is the specific gravity of the ink droplet;

$v_0$ is the ejection speed of the ink droplet;

q is the charge amount of the ink droplet; and

E is the vertical direction V component of the electric field E2.

As can be understood from equation (4), the flight speed $v_0$ needs to be a small value in order to prevent the refresh ink droplet 806 from impinging on the continuous recording sheet 602. According to the present embodiment, the ejection speed $V_0$ of recording ink droplets is 7 m/s to 8 m/s, but the ejection speed $V_0$ of the refresh ink droplet 806 is set to 4.0 m/s. The ejection speed $V_0$ is set slower for the refresh ink droplet 806 by reducing the voltage value of the analog drive signal 406 to a lower value for the refresh drive signal 904 than when ejecting recording ink droplets. By setting the ejection speed $V_0$ of the refresh ink droplet 806 to 4.0 m/s, the maximum distance 1=1.0 mm, which is shorter than the distance D1 from the nozzle orifice 301 to the continuous recording sheet 602. Therefore, the refresh ink droplet 806 U-turns before reaching the continuous recording sheet 602 and will not impinge on the continuous recording sheet 602. The entire process from when the refresh ink droplet 806 being ejected, to when the refresh ink droplet 806 U-turns, and further to when the ink is collected by the metal mesh 802 takes about 100 microseconds to 1 millisecond. Therefore, the positive voltage Vcp needs to be maintained at the common electric field signal 113 during this period. The common electric field signal 113 is maintained at a fixed negative voltage during the period ts2 for this reason.

Next, recording ink droplets are ejected one after the other when the analog drive signal 406 is generated in synchronization with the sheet position synchronization signals 109-3, 109-4, 109-5. The ink droplets ejected as a result of the sheet position synchronization signals 109-3, 109-4, 109-5 will be referred to as recording ink droplets 806-3, 806-4, and 806-5, respectively. The recording ink droplets 806-3, 806-4, and 806-5 will be explained with reference to FIG. 11.

In the same manner as for the refresh ink droplet 806, the recording ink droplet 806-3 breaks away from the meniscus after extending to a certain length. The separation occurs at timing T2 indicated in FIG. 10. Because the positive voltage Vcp is applied to the sheet back electrode 805 at the break away timing T2, the recording ink droplet 806-3 is charged to a negative charge by the electric field E2. The negatively charged recording ink droplet 806-3 is accelerated by the electric field E2. At this time, the recording ink droplet 806-3 is deflected to the left as shown in FIG. 9 because the electric field E2 slants slightly to the right. Therefore, the recording ink droplet 806-3 impinges on the continuous recording sheet 602 at a position that is to the left of a line C that is normal from the nozzle orifice 301. In other words, the recording ink droplet 806-3 impinges on the continuous recording sheet 602 at a position that is shifted upstream with respect to the sheet transport direction Y.

The recording ink droplet 806-4 is charged, accelerated, and deflected in the same manner as the recording ink droplet 806-3 and also impinges on the continuous recording sheet 602 at a position b that is shifted to the left from the normal line C. However, starting from the timing T2, the positive voltage Vcp of the common electric field signal 113 gradually drops so that the acceleration and deflection amount of the recording ink droplet 806-4 is less than for the recording ink droplet 806-3. Therefore, the impingement position b is shifted from the normal line C to a smaller extent than the impingement position a. The acceleration and deflection amount is even smaller for the recording ink droplet 806-5 so the recording ink droplet 806-5 impinges at a position c at the timing T3. It should be noted that there is no need for the positive voltage Vcp to decrease in a continuous manner. The positive voltage Vcp may be reduced in a stepwise manner each time a recording ink droplet is ejected.

Figure 11:
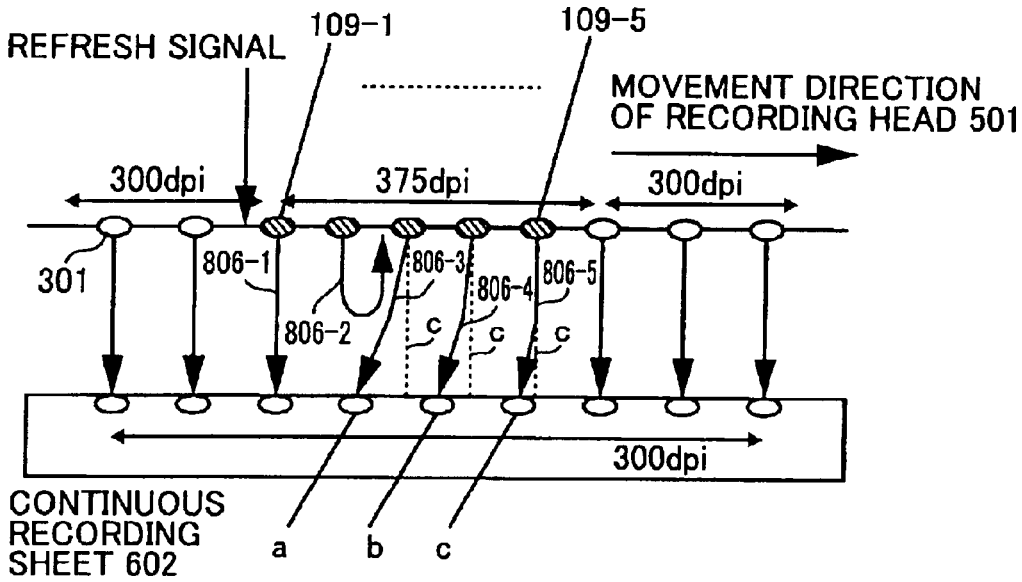
FIG. 11 is a schematic view showing trajectory of ink droplets ejected during a normal ejection mode and an ink refresh ejection made.

Next, a series of operations performed by the inkjet recording device 1 during printing will be explained with reference to FIG. 11. FIG. 11 shows the condition of ink droplets ejected from a single nozzle orifice 301 during both the normal ejection mode and the refresh ejection mode. FIG. 11 shows the recording head 501 relatively moving from left to right across the continuous recording sheet 602. That is, FIG. 11 shows the relative position of the single nozzle orifice 301 at different consecutive times. It should be noted that the speed component in the movement direction of the recording head 501 is not taken into consideration.

In the example shown in FIG. 11, at first printing is performed in the normal ejection mode. During this time, recording ink droplets are ejected at timings corresponding to sheet position synchronization signals 109 for the resolution of 300 dpi. At this time, the common electric field signal 113 is not generated so the recording ink droplets move straight downward toward the continuous recording sheet 602 without any deflection. Next, the inkjet recording device 1 switches to the refresh ejection mode when the refresh signal 121 is generated. After the refresh signal 121 is generated, the five sheet position synchronization signals 109-1 to 109-5 are generated at timings that correspond to 375 dpi.

The recording ink droplet 806-1 that is ejected at the timing of the sheet-position synchronization signal 109-1 is not charged so flies in a straight line toward the continuous recording sheet 602 and will not be deflected even if the electric field E1 is developed directly after the recording ink droplet 806-1 is ejected. The recording ink droplet 806-2 that is ejected at the timing of the sheet-position synchronization signal 109-2 is charged to a positive charge by the electric field E1. Therefore, the recording ink droplet 806-2 U-turns under influence from the positive polarity deflection electric field E2 and is caught on the ink collection electrode 801. A period of about 100 microseconds to 1 millisecond elapses from when the recording ink droplet 806-2 is ejected until it is collected. The positive polarity deflection electric field E2 is maintained during this entire period. The three recording ink droplets 806-3, 806-4, and 806-5 are ejected while the recording ink droplet 506-2 is in flight, that is, while positive polarity deflection electric field E2 is being maintained, so are deflected in the manner described above before impinging on the continuous recording sheet 602.

The recording ink droplets 806-3, 806-4, and 806-5 ejected at the timings of the sheet position synchronization signals 109-3 to 109-5 impinge on the continuous recording sheet 602 at positions a, b, and c, respectively. The impinging positions of the ink droplets are separated by a uniform distance whether ejected during the normal ejection mode or during the refresh ejection mode. Therefore, even though the ink refresh operation is performed during recording, recording can be performed at the same resolution of 300 dpi as when no ink refresh operation is performed. When ink ejection during the refresh ejection mode is completed, the inkjet recording device 1 automatically returns to the normal ejection mode.

According to the present embodiment, an ink refresh operation can be performed at any optional timing while recording is being performed at a frequency of 8 kHz, which is 80% of the maximum ejection frequency fm of 10 kHz.

As described above, according to the present invention, the refresh ejection period can be secured by temporarily changing the ejection frequency. Refresh operations can be performed using the resultant time-sharing refresh method with a loss in ejection speed of only a few percentages compared to the maximum ejection speed. Because the refresh ink droplets are deflected and collected, there is no need to provide a complicated mechanism for retracting the recording head or stopping recording operations each time a refresh operation is performed.

Because a recording ink droplet ejected during the refresh ejection mode impinges on a position that is shifted from an imaginary normal line that extends from the corresponding nozzle orifice, normal recording can be performed at a predetermined interval with no dots missing from the recorded image because of the refresh ejection.

Because ink droplets ejected in the refresh ejection mode impinge at positions that are shifted in accordance with the deflection amount by gradually smaller distances, normal recording can be performed at a predetermined interval with no dots missing from the recorded image because of the refresh ejection.

Because the ejection frequency is temporarily changed at an optional timing, the ink refresh operations need not be performed in synchronization with the recording signal. Instead, whether or not a refresh operation is to be performed can be judged based on a variety of conditions, such as elapse of a fixed period, recording history, environmental conditions, passage of time, or ink conditions.

While the invention has been described in detail with reference to the specific embodiments thereof, it would be apparent to those skilled in the art that various changes and modifications may be made therein without departing from the spirit of the invention.

For example, the embodiment describes generating five sheet position synchronization signals 109 at 375 dpi during the refresh ejection mode while the continuous recording sheet 602 is transported a distance equivalent to 4 dots at 300 dpi of the normal ejection mode. However, 10 sheet position synchronization signals 109 could be generated at 333 dpi while transporting the continuous recording sheet 602 a distance equivalent to 9 dots at 300 dpi. With this configuration, recording can be performed at 9 kHz, which is 90% of the maximum ejection frequency fm of 10 kHz.

The embodiment describes ejecting refresh droplets from all of the nozzles during the refresh ejection mode. However, refresh droplets need only be ejected from optional nozzles that require an ink refresh operation. That is, the need for an ink refresh operation differs for each nozzle depending on the conditions that recording ink droplets were ejected. If refresh droplets are ejected only from nozzles that require an ink refresh operation, then a great deal of ink can be saved, especially in the case of inkjet recording devices with a large number of nozzles. In this case, the refresh signal generator is controlled to generate refresh signals that eject ink droplets only from those nozzles that need an ink refresh operation.

What is claimed is:

1. An inkjet recording device comprising:

a plurality of nozzles for ejecting ink droplets;

a first signal generator that generates a recording ejection signal, wherein the nozzles selectively eject a recording ink droplet in response to the recording ejection signal;

a changing unit that, during a frequency changing period, temporarily changes an ejection frequency that is common to all of the nozzles;

a second signal generator that generates a refresh ejection signal during the frequency changing period, wherein the nozzles selectively eject a refresh ink droplet in response to the refresh ejection signal;

an electric field generator that generates an electric field for deflecting the refresh ink droplet; and an ink collector that collects the deflected refresh ink droplet.

2. The inkjet recording device according to claim 1, wherein the recording ejection signal includes a recording analog signal and a recording digital signal, and the refresh ejection signal includes a refresh analog signal and a refresh digital signal, the refresh digital signal having a lower voltage than the recording digital signal.

3. The inkjet recording device according to claim 1, wherein the first signal generator generates the recording ejection signal during the frequency changing period, and the electric field deflects at least one recording ink droplet that is ejected during the frequency changing period to impinge on a recording medium.

4. The inkjet recording device according to claim 3, further comprising a transport unit that transports a recording medium in a predetermined direction, wherein the electric field deflects the at least one recording ink droplet in the predetermined direction.

5. The inkjet recording device according to claim 4, wherein the changing unit temporarily increases the ejection frequency during the frequency changing period.

6. The inkjet recording device according to claim 1, wherein the electric field generator includes an electrode and a signal applicator, the signal applicator applying a common electric field signal to the electrode, the common electric field signal reducing in its voltage value in at least one of a stepwise manner and a continuous manner after the refresh ink droplet is ejected.

7. The inkjet recording device according to claim 1, wherein the changing unit temporarily changes the ejection frequency at an optional timing.

8. The inkjet recording device according to claim 1, wherein the changing unit generates a synchronization signal, the first signal generator and the second signal generator generate the recording ejection signal and the refresh ejection signal, respectively, in synchronization with the synchronization signal, and the changing unit temporarily changes the ejection frequency by temporarily changing generation timing of the synchronization signal.

* * * * *

UNITED STATES PATENT AND TRADEMARK OFFICE

CERTIFICATE OF CORRECTION

PATENT NO. : 6,908,166 B2
DATED : June 21, 2005
INVENTOR(S) : Kobayashi et al.

It is certified that error appears in the above-identified patent and that said Letters Patent is hereby corrected as shown below:

Column 10,
Line 38, please replace "-15 kV" with -- -1.5 kV --.

Signed and Sealed this

Sixteenth Day of August, 2005

JON W. DUDAS
*Director of the United States Patent and Trademark Office*